US006891100B2

(12) United States Patent
Crouch

(10) Patent No.: US 6,891,100 B2
(45) Date of Patent: May 10, 2005

(54) DRUM CARRIER AND VIBRATION ISOLATION SUPPORT SYSTEM

(76) Inventor: Steve P. Crouch, 51 Memorial Ct., Highland, IL (US) 62249

( * ) Notice: Subject to any disclaimer, the term of this patent is extended or adjusted under 35 U.S.C. 154(b) by 0 days.

(21) Appl. No.: 10/783,752

(22) Filed: Feb. 20, 2004

(65) Prior Publication Data

US 2004/0159211 A1 Aug. 19, 2004

Related U.S. Application Data

(62) Division of application No. 10/383,037, filed on Mar. 6, 2003, now Pat. No. 6,765,140.
(60) Provisional application No. 60/372,494, filed on Apr. 12, 2002.

(51) Int. Cl.[7] ..... G10D 13/02
(52) U.S. Cl. ..... 84/421; 84/411 R
(58) Field of Search ..... 84/421, 411 R, 84/417, 412–420

(56) References Cited

U.S. PATENT DOCUMENTS 4,928,565 A * 5/1990 Hsieh ..... 84/411 R
5,427,009 A * 6/1995 LaPlante ..... 84/413

* cited by examiner

*Primary Examiner*—Kim Lockett
(74) *Attorney, Agent, or Firm*—Polster, Lieder, Woodruff & Lucchesi, L.C.

(57) ABSTRACT

A shoulder supported percussion musical instrument carrier and vibration isolation support assembly providing support for a plurality of percussion musical instruments on a person while standing, walking, or marching. Each of the percussion musical instruments is detachably secured between upper and lower plates of an instrument support frame utilizing one or more tension element casings located about the circumference of each instrument. The instrument support frame, in turn, is secured to a supporting vest including vibration isolated shoulder straps. A special bushing is used in conjunction with the tension lugs of the percussion instrument to reduce friction coefficient and to maintain the alignment of the tension lugs.

11 Claims, 7 Drawing Sheets

DRUM CARRIER AND VIBRATION ISOLATION SUPPORT SYSTEM

CROSS-REFERENCE TO RELATED APPLICATIONS

The application is a divisional application related to non-provisional patent application Ser. No. 10/383,037 filed on Mar. 6, 2003 now U.S. Pat. No. 6,765,140, that in turn claims priority of provisional patent application Ser. No. 60/372,494 that was filed on Apr. 12, 2002.

STATEMENT REGARDING FEDERALLY SPONSORED RESEARCH

Not Applicable.

BACKGROUND OF THE INVENTION

The present invention relates to an apparatus for carrying percussion musical instruments, particularly drums of various kinds, and more particularly, to an a carrier hardware providing an attachment structure for the tension members of percussion instruments and to a vibration isolation system for supporting the carrier on a person while standing, walking, or marching.

The prior art discloses many examples of apparatus for supporting percussion instruments such as drums, but none providing the combination of features disclosed and claimed herein. Structures for carrying percussion musical instruments must provide a balance between the comfort of the person walking, standing, or marching while wearing the instruments, and the mounting of the instruments in a desired playing position. Where the instruments are rigidly maintained at a particular playing position, the straps or structure associated with the carrier can cause painful discomfort to the marcher. Thus it is important to provide an instrument carrier with an apparatus which maintains the playing instruments in a given playing position while at the same time providing an increased measure of player comfort. Additionally, the manner in which the instruments are mounted to the carrier is of great importance. The mounting should not affect the musical characteristics of the instruments nor position them in such a manner that the person carrying them cannot properly play the instruments. In the past, marching tom drums, for example, generally were mounted to support structures by drilling openings in the drum shell and making the interconnection to the support through the shell. I believe the breech of shell integrity may affect the sound characteristics of the drum. Even if that is not the case, however, attachments through the shell make it difficult to mount and/or remove the drum from the support structure.

U.S. Pat. No. 3,106,123 to Johannsen discloses a holder for a single marching drum which clasps adjacent vertical drum rod members and is attached to the drum through those members. The holder is further secured to a pair of shoulder straps and a bracing strap configured to rest on the chest or stomach of a person wearing the holder.

U.S. Pat. No. 4,256,007 to Streit discloses a percussion instrument carrier for securing a single percussion instrument in a playing position while being carried by a person standing, walking, or marching. The single percussion instrument is secured in place to a structure worn on the person by a flexible tie-down cord and a number of L-clamps affixed at opposite corners of the instrument.

U.S. Pat. No. 6,329,583 to May discloses a carrier for percussion instruments comprising a supporting vest of composite material, rigid removable shoulder straps of light metal, and a back bar of light metal such as aluminum or magnesium. The percussion instruments are supported on a pair of J-bars mounted on the carrier in an adjustable manner. The shoulder straps specifically are intended for removal for the substitution of straps of different sizes. The straps are secured with adjustable connections permitting removal, replacement, longitudinal, and angular adjustment for comfort.

Accordingly, there is a need for a wearable carrier for percussion musical instruments which provides an adjustable attachment structure for detachably positioning a number of musical instruments in proper playing locations, and for providing a vibration attenuating supporting structure.

BRIEF SUMMARY OF THE INVENTION

Briefly stated, the percussion musical instrument carrier and vibration isolation support assembly of the present invention provides a person with an apparatus by which a plurality of percussion musical instruments such as marching tom drums may be supported on the person while standing, walking, or marching. Each of the percussion musical instruments is detachably secured between upper and lower plates of an instrument support utilizing the casings of one or more tension elements located about the circumference of each instrument. The support frame, in turn, is secured to a supporting vest having vibration isolated shoulder straps adapted to be worn by the person.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
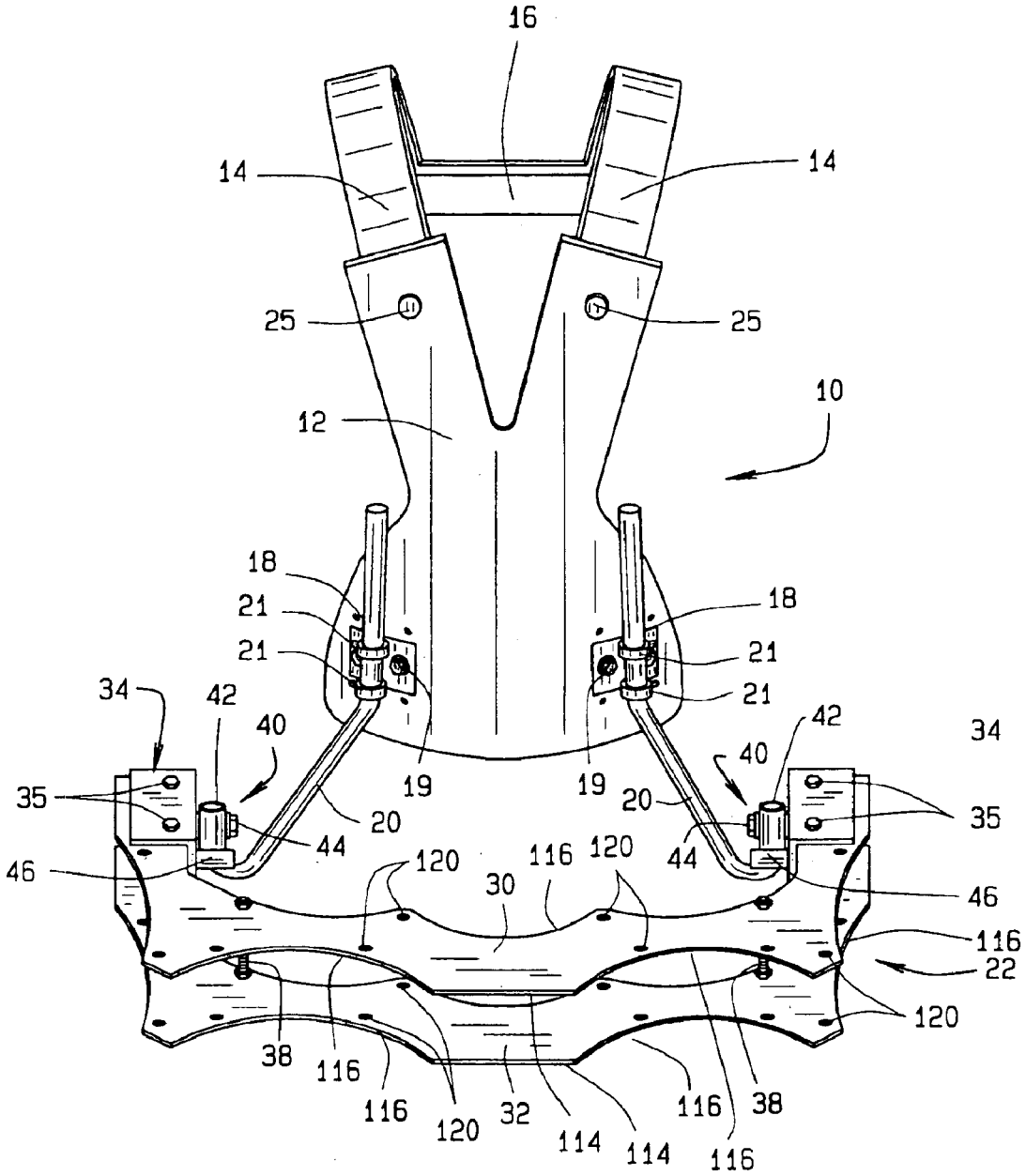
FIG. 1 is a front perspective view of the drum carrier and vibration isolation support system of the present invention.
Figure 2:
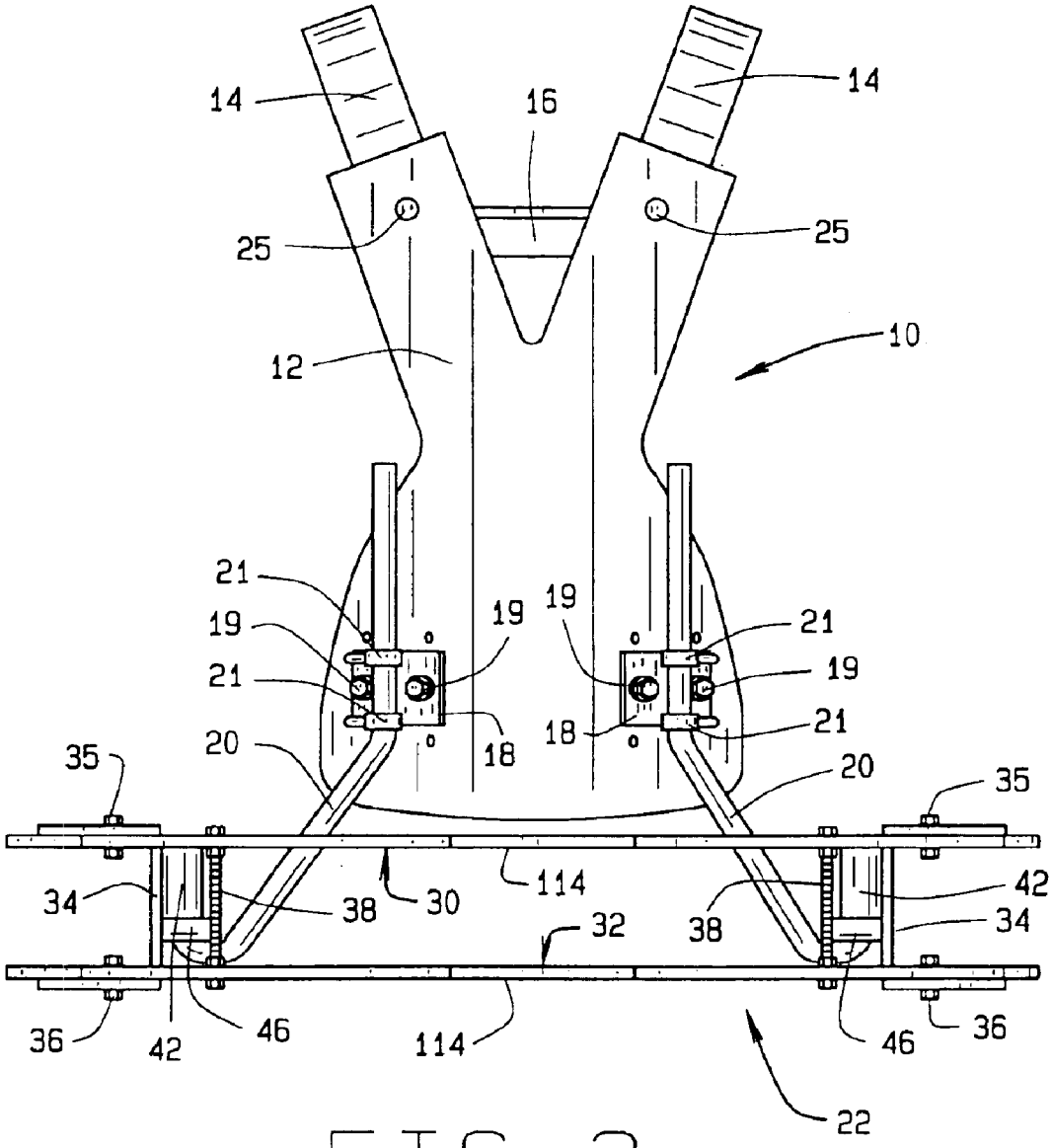
FIG. 2 is a front view of the drum carrier and vibration isolation support system of the present invention.

Referring to FIGS. 1 and 2, a shoulder supported percussion musical instrument carrier and vibration isolation support system of the present invention is shown generally at 10. The carrier comprises a belly-plate or vest portion 12 adapted to fit the torso of a wearer, a pair of shoulder straps 14, each secured to the vest portion 12 at a first end, and a back bar 16 linking the opposite ends of the shoulder straps 14 together. A pair of support rod receptacles 18 are secured to the front surface of the vest portion 12 by bolts or rivets 19. Support rods 20, preferably J-rods, are supported in the receptacles 18 and secured in position by set screws 21. Each J-rod 20 may be adjusted vertically and rotationally within the support rod receptacle 18, providing vertical movement for height adjustment, and rotational movement in a horizontal plane for altering the spacing between the opposite ends of the J-rods 20. A percussion instrument support frame 22 is secured to the J-rods 20, opposite the front surface of the vest portion 12.

Figure 6:
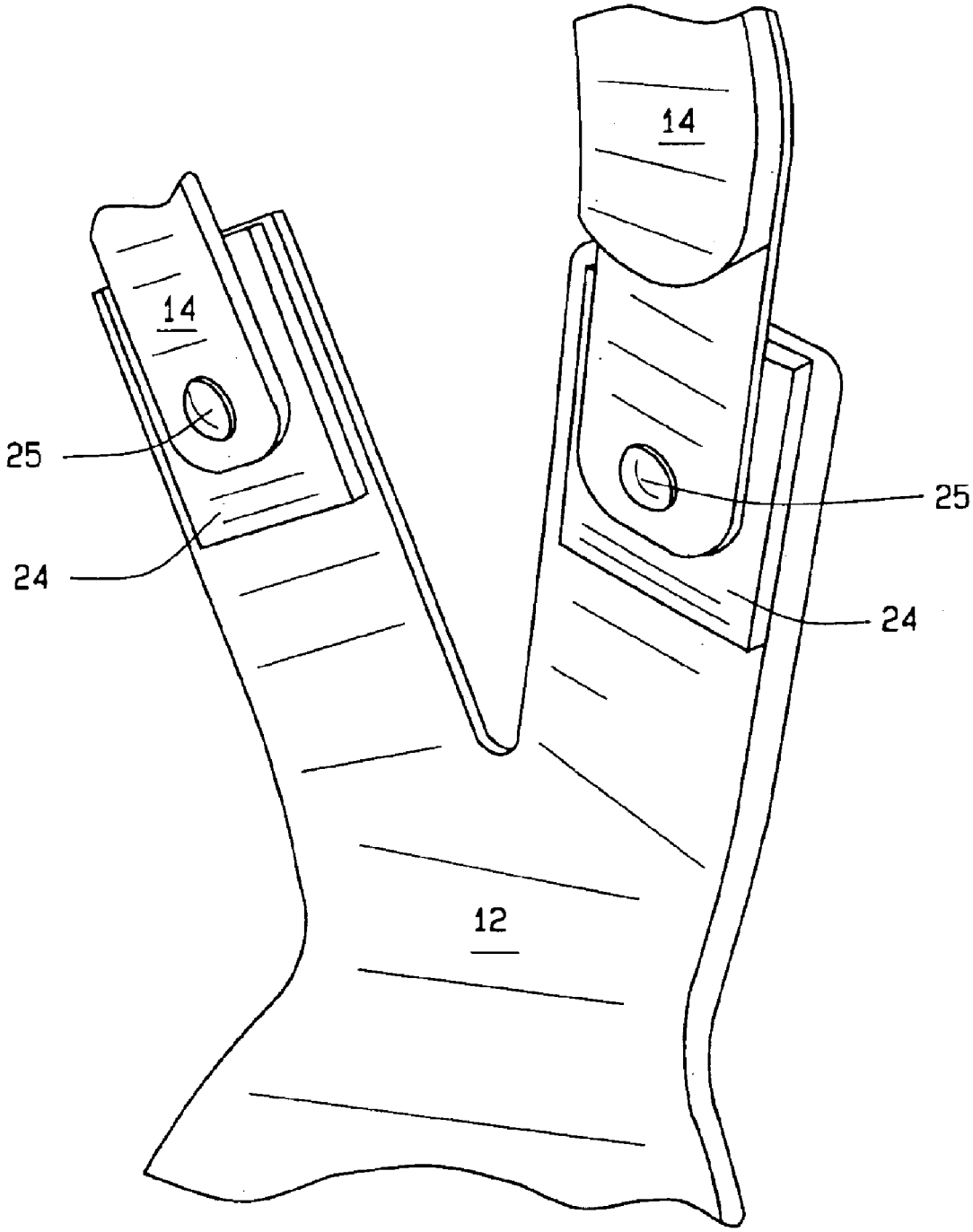
FIG. 6 is a enlarged perspective view of the vibration isolation components of the present invention.

Each of the shoulder straps 14 is secured to the vest portion 12 with a vibration attenuating element 24 to provide vibration isolation between the vest portion 12 upon which the percussion instruments are carried, and the shoulder straps 14. The vibration attenuating element 24, shown in FIG. 6, is preferably composed of a rubber or similar material having vibration isolating or attenuating properties interposed between the vest portion 12 and each shoulder strap 14. A bolt or rivet 25 integral with, or passing through, the vibration attenuating element 24 secures the respective shoulder strap 14 to the vest portion 12. Those of ordinary skill in the art will recognize that a wide variety of materials having vibration isolating properties may be utilized as the vibration attenuating elements 24. Correspondingly, the bolt or rivet 25 may be replaced by other conventional connectors to secure each shoulder strap 14 to the vest portion 12.

The percussion instrument support frame 22 comprises an upper instrument support plate 30 and a lower instrument support plate 32, secured in a predetermined spaced relationship by a pair of C-brackets 34. In the embodiment shown in FIGS. 1 and 2, the upper instrument support plate 30 is secured to the upper extensions of each of the C-brackets 34 by bolts or rivets 35. Correspondingly, the lower instrument support plate 32 is secured to the lower extensions of each of the C-brackets 34 by bolts or rivets 36. One or more support rods 38 are secured between the upper instrument support plate 30 and the lower instrument support plate 32, to increase the stability thereof, and to facilitating maintaining the spaced relationship.

To secure the percussion instrument support frame 22 to the J-rods 20, each of the C-brackets 34 includes a rod receiver 40. Each C-bracket 34 is a mirror image of the other, and accordingly, the following description will describe only one C-bracket 34. Corresponding reference numerals in the figures identify corresponding components on each C-bracket.

The rod receiver 40 comprises a section of tube 42 having an inner diameter sized to receive an end of the J-rod 20 in a friction fit. The tube 42 is secured to the C-bracket 34 by an adjustable bolt 44 passing diametrically through the tube 42 adjacent an upper end 43. The orientation of the longitudinal axis of tube 42 may be adjusted parallel to the face of the C-bracket 34 by pivoting the tube 42 about the adjustable bolt 44, thereby permitting the percussion instrument support frame 22 to be orientated at an angle relative to either the ground or the J-rod 20. A stop 46 is secured to the C-bracket to provide for perpendicular alignment between the planes defined by the upper and lower instrument support plates 30, 32 and the longitudinal axis of tube 42.

During use, the upturned end of each J-rod 20 is seated within a corresponding rod receiver 40 from the lower end of each tube 42. The percussion instrument support frame 22 is oriented at a desired angle relative to the J-rods 20, by pivoting each tube 42 about the adjustable bolts 44. Once the desired angle is achieved, the adjustable bolts 44 are tightened to secure each tube 42 in a fixed relationship to the C-bracket 34 on which it is mounted.

Figure 3:
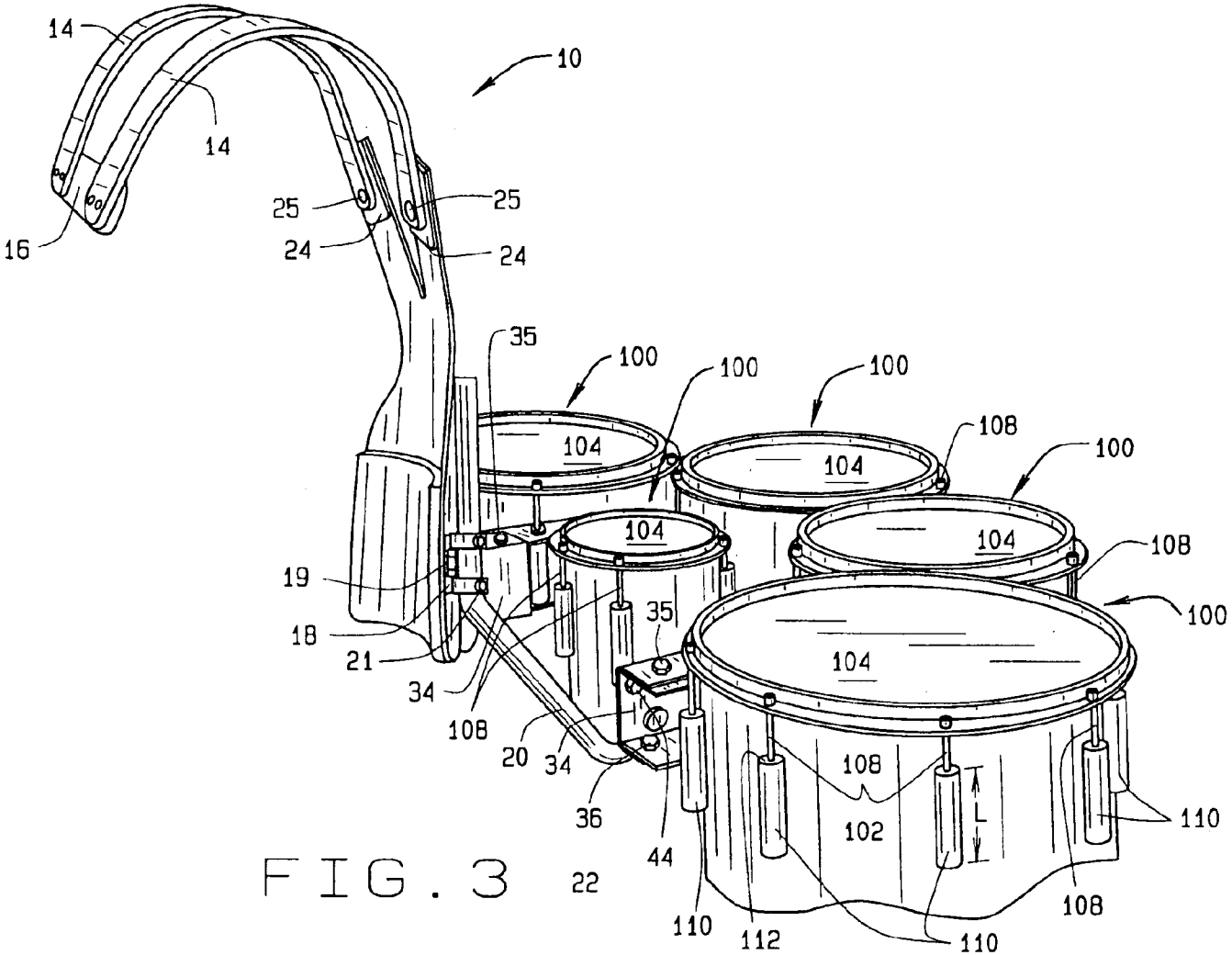
FIG. 3 is a side perspective view of the drum carrier and vibration isolation support system of the present invention.
Figure 4:
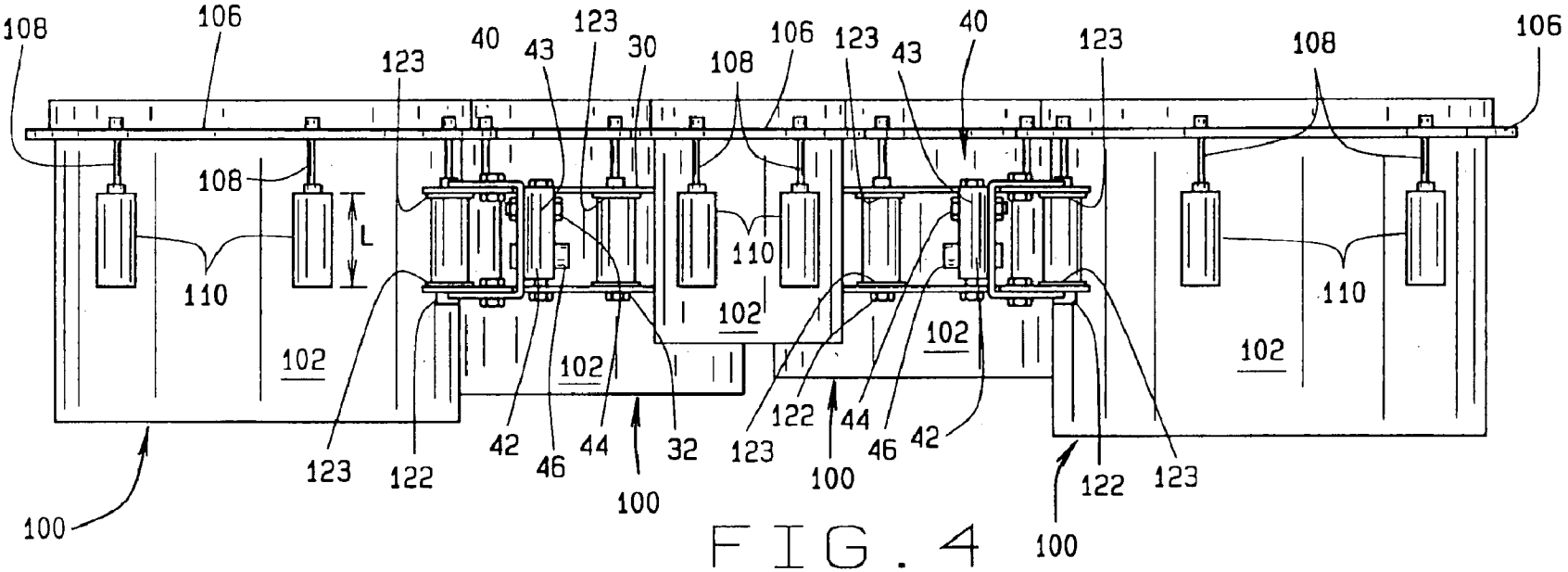
FIG. 4 is a rear view of the drum carrier of the present invention supporting a plurality of drums.
Figure 5:
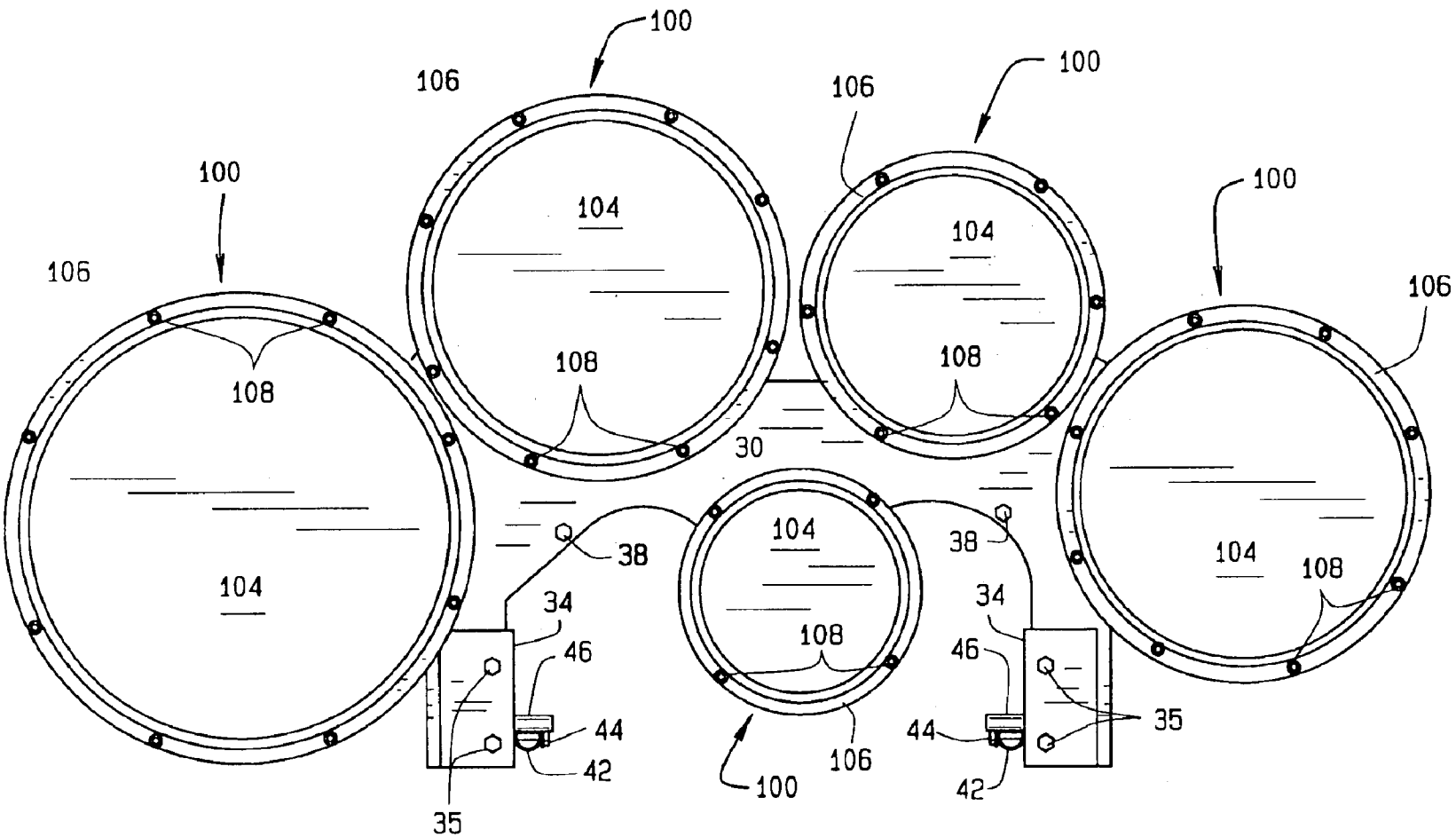
FIG. 5 is a top view of the drum carrier of the present invention shown in FIG. 4.

Turning to FIG. 3 through FIG. 5, there is shown one or more percussion musical instruments 100 secured to the percussion instrument support frame 22. Each percussion musical instrument 100 includes a cylindrical body or shell 102 and a drum head 104 stretched over the upper end of the shell 102. The drum head 104 is secured to the shell 102 by a rim 106 which bears on the upper edge of the shell 102. A plurality of equidistantly spaced tension lugs 108 extend through the rim 106 and are threaded into casings 110 fastened to the side of the shell 102. Each casing 110 has a predetermined length L, and an axially disposed threaded bore 112, open at each end, into which a tension lug 108 is threaded.

Referring to FIG. 1, it is shown that the upper and lower instrument support plates 30, 32 each include, along corresponding peripheral edges 114, a plurality of vertically aligned curved recesses 116. Each curved recess 116 has a radius and a radial dimension. The radial dimension corresponding to an outer radial dimension of a percussion musical instrument 100 intended for attachment at that location. Further shown in FIG. 1 are a plurality of vertically aligned instrument attachment points 120, preferably bolt receiving bores, adjacent each curved recess 116, and spaced about each curved recess 116 in positions corresponding to the placement of casings 110 about the shell 102 of a percussion musical instrument 100 intended for attachment at that location.

The predetermined spaced relationship between the upper and lower instrument support plates 30, 32, as defined by the dimension of the C-brackets 34, is greater than the predetermined length L of the casings 110 on the percussion musical instruments 100 intended for attachment to the percussion instrument support frame 22. To secure a percussion musical instrument 100 to the support frame 22, one or more of the tension lugs 108 are removed from the rim 106 and casings 110. The percussion musical instrument 100 is then positioned within a curved recess 116 in the upper and lower instrument support plates 30, 32, such that the peripheral edges 114 of the support plates 30, 32 abut the shell 102. Next, the percussion musical instrument 100 is rotated to bring the threaded bore 112 of at least one casing 110 from which the tension lug 108 has been removed into alignment between the upper and lower support plates 30, 32 with a vertically aligned pair of bolt receiving bores 120. The tension lug 108 is then replaced through the rim 106, passing through a bolt receiving bore 120 in the upper support plate 30, and threaded into the threaded bore 112 of the casing 110.

Figure 7:
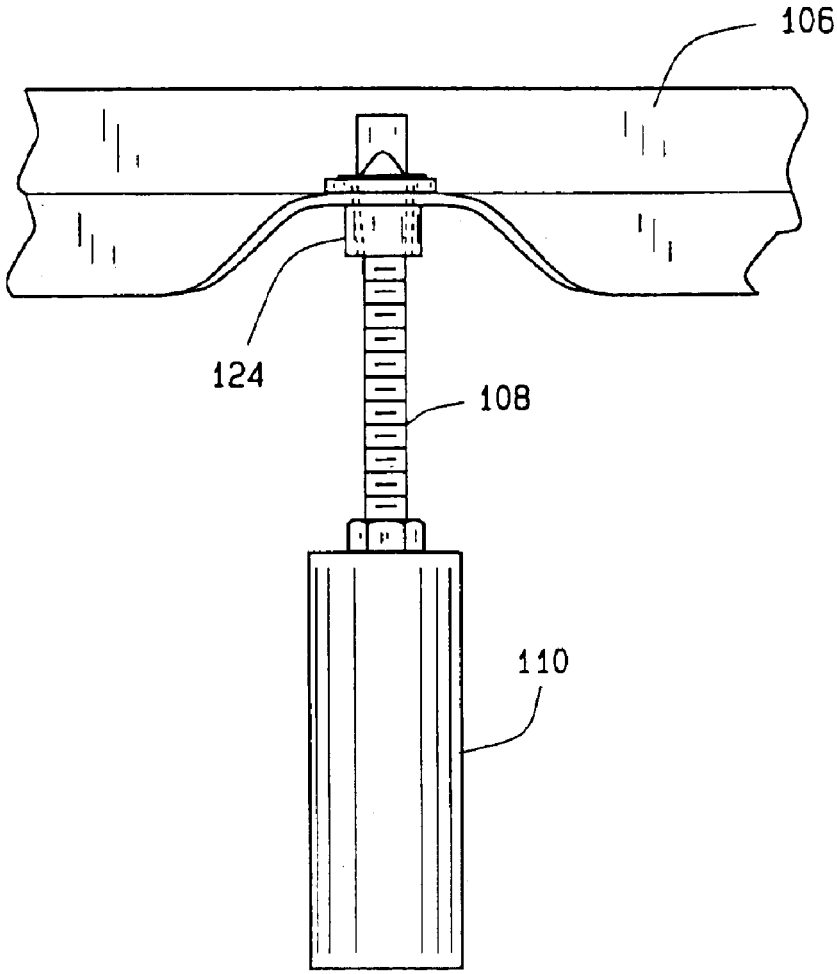
FIG. 7 is a side view of a percussion musical instrument showing the installation the tension lug bushing.
Figure 8:
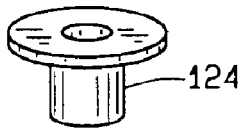
FIG. 8 is a perspective view of the bushing.

During installation of the tension lug 108, one vibration isolation washer 123 is installed above the casing 110 and one vibration isolation washer 123 is installed below the casing 110. While the two vibration isolation washers may be made from any resilient material, it is preferred that the vibration isolation washers 123 be made from neoprene material. A bushing 124 (FIGS. 7 and 8) are placed into the opening within the rims 106 prior to installation of the tension lugs 108. The bushing 124 reduces the friction between the tension lugs 108 and the rim 106 to provide a finer ability to adjust the tension in the tension lug 108.

Additionally, the bushings 124 act to keep the vertical axial tension loads perpendicular to the upper surface of the rim 106, thereby greatly reducing the tendency to create a bending moment in the tension lug 108 as the tension lug is tightened. While the bushing 124 made be made of any material which reduces the friction coefficient between the metal of the rim 106 and the tension rod 108, it is preferred that the bushing be made from a brass material. It will also be appreciated that while the bushing 124 is part of the drum carrier 10, the bushing may also be used on any drum percussion instrument having a rim 106 used for tightening a drum head 104 onto a drum shell 102.

A retaining bolt 122 is correspondingly passed upward through a bolt receiving bore 120 in the lower support plate 32 and threaded into the threaded bore 112 of the casing 110, opposite the tension lug 108. Preferably, at least two casings are secured between the upper and lower support plates 30, 32 in this manner for each percussion musical instrument 100.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In a percussion instrument having a head, a shell, a rim member with a plurality of openings, a plurality of tension lugs, and a plurality of casings, the improvement comprising a bushing, the bushing being sized to fit into at least one of the plurality of openings in the rim member, and the bushing being configured to accept the tension lug as the tension lug is inserted into one of the plurality of openings in the rim member and into one of the plurality of casings to thereby tighten the rim member to hold the head in position on the shell.

2. The bushing of claim 1 wherein the bushing functions to reduce the friction coefficient between the rim and the tension lug.

3. The bushing of claim 2 wherein the bushing functions to keep vertical axial tension loads perpendicular to the upper surface of the rim to reduce the tendency to creating a bending moment in the tension lug as the tension lug is tightened.

4. The bushing of claim 3 wherein the bushing is in the general form of a hollow high hat that includes a disc-shaped portion in combination with a cylindrical tube portion such that an inside diameter of the disc-shaped portion matches an inside diameter of the cylindrical tube portion and the disc-shaped portion is located at an end of the cylindrical tube portion such that the inside diameter of the disc-shaped portion is axially aligned with the inside diameter of the cylindrical tube portion.

5. The bushing of claim 4 wherein the bushing is made from a friction reducing metal material.

6. The bushing of claim 5 wherein the bushing is made from brass.

7. The process of inserting a bushing into a percussion instrument having a head, a shell, a rim member with a plurality of openings, a plurality of tension lugs, and a plurality of casings, comprising the steps of:

sizing the bushing to fit into at least one of the plurality of openings in the rim member; and configuring the bushing to accept at least one of plurality of tension lug as the tension lug is inserted into at least one of the plurality of openings in the rim member and into at least one of the plurality of casings to thereby tighten the rim member to hold the head in position on the shell.

8. The process of claim 7 further comprising the step of enabling the bushing to reduce the friction coefficient between the rim member and at least one of plurality of the tension lugs.

9. The process of claim 8 further comprising the step of enabling the bushing to tend to keep vertical axial tension loads perpendicular to the upper surface of the rim member.

10. The process of claim 9 further comprising the step of enabling the bushing to tend to reduce the propensity to create a bending moment in at least one of the plurality of tension lugs as the tension lug is tightened.

11. The process of claim 10 further comprising the step of manufacturing the bushing in the general form of a hollow high hat that includes a disc-shaped portion in combination with a cylindrical tube portion such that an inside diameter of the disc-shaped portion matches an inside diameter of the cylindrical tube portion and the disc-shaped portion is located at an end of the cylindrical tube portion such that the inside diameter of the disc-shaped portion is axially aligned with the inside diameter of the cylindrical tube portion.

* * * * *